US009250010B2

(12) United States Patent
De La Garza et al.

(10) Patent No.: US 9,250,010 B2
(45) Date of Patent: Feb. 2, 2016

(54) REFRIGERATOR SHELF WITH GLASS RECEIVING SLOT

(75) Inventors: Rogelio De La Garza, Coahuila (MX); Frank Klitzing, Evansville, IN (US); Carlos Lopez, Monterrey (MX); Rafael Rivera, Monterrey (MX)

(73) Assignee: Whirlpool Corporation, Benton Harbor, MI (US)

( * ) Notice: Subject to any disclaimer, the term of this patent is extended or adjusted under 35 U.S.C. 154(b) by 1403 days.

(21) Appl. No.: 12/641,745

(22) Filed: Dec. 18, 2009

(65) Prior Publication Data

US 2010/0181884 A1 Jul. 22, 2010

Related U.S. Application Data

(60) Provisional application No. 61/145,359, filed on Jan. 16, 2009.

(51) Int. Cl.
*F25D 25/02* (2006.01)
*F25D 23/02* (2006.01)

(52) U.S. Cl.
CPC ..... *F25D 25/024* (2013.01); *F25D 2325/022* (2013.01); *Y10T 29/49826* (2015.01)

(58) Field of Classification Search
CPC ..... F25D 25/024; F25D 2325/022; Y10T 29/49826
USPC ..... 108/106–108; 312/408, 404, 351; 62/302, 465
See application file for complete search history.

(56) References Cited

U.S. PATENT DOCUMENTS

| | | | | | |
|---|---|---|---|---|---|
| 4,691,887 | A | * | 9/1987 | Bessinger | 248/250 |
| 4,881,708 | A | * | 11/1989 | Walter | 248/243 |
| 4,923,260 | A | | 5/1990 | Poulsen | |
| 4,934,541 | A | | 6/1990 | Bussan et al. | |
| 4,936,641 | A | | 6/1990 | Bussan et al. | |
| 4,960,308 | A | * | 10/1990 | Donaghy | 312/404 |
| 5,332,611 | A | * | 7/1994 | Shanok et al. | 428/122 |
| 5,340,209 | A | * | 8/1994 | Kolbe et al. | 312/408 |
| 5,362,145 | A | | 11/1994 | Bird et al. | |
| 5,403,083 | A | | 4/1995 | Dasher et al. | |
| 5,403,084 | A | | 4/1995 | Kane et al. | |
| 5,429,433 | A | | 7/1995 | Bird et al. | |
| 5,441,338 | A | | 8/1995 | Kane et al. | |
| 5,516,204 | A | * | 5/1996 | Calvert et al. | 312/408 |
| 5,524,981 | A | * | 6/1996 | Herrmann et al. | 312/408 |
| 5,540,493 | A | | 7/1996 | Kane et al. | |
| 5,564,809 | A | | 10/1996 | Kane et al. | |
| 5,660,777 | A | * | 8/1997 | Herrmann et al. | 264/154 |
| 5,677,030 | A | * | 10/1997 | Shanok et al. | 428/122 |
| 5,735,589 | A | * | 4/1998 | Herrmann et al. | 312/408 |
| 5,813,741 | A | * | 9/1998 | Fish et al. | 312/408 |
| 6,045,101 | A | * | 4/2000 | Goyette et al. | 248/235 |
| 6,422,673 | B1 | | 7/2002 | Bienick | |
| 6,488,347 | B1 | | 12/2002 | Bienick | |

(Continued)

*Primary Examiner* — Andrew Roersma

(57) ABSTRACT

An encapsulated refrigerator shelf is assembled by interconnecting a platform, such as a glass panel, within a peripheral frame. More specifically, a peripheral shelf frame is formed with a split side portion defining upper and lower frame portions which are spaced by an elongated slot. The encapsulated glass refrigerator shelf is made by slidably inserting the platform onto peripheral frame support structure through the slot formed between the upper and lower frame portions. The frame is also formed with retaining structure to maintain the platform in place once the platform is inserted a requisite amount within the peripheral frame.

20 Claims, 5 Drawing Sheets

(56) References Cited

U.S. PATENT DOCUMENTS

| | | | | |
|---|---|---|---|---|
| 6,679,573 | B2 | 1/2004 | Bienick | |
| 6,729,704 | B2 * | 5/2004 | Ames | 312/408 |
| 6,786,562 | B2 | 9/2004 | Obrock et al. | |
| 6,811,045 | B1 | 11/2004 | Masker et al. | |
| 6,851,776 | B2 | 2/2005 | Bienick | |
| 6,962,116 | B2 | 11/2005 | Bienick et al. | |
| 6,966,267 | B2 | 11/2005 | Bienick | |
| 7,073,876 | B2 | 7/2006 | Wing et al. | |
| 7,101,002 | B2 | 9/2006 | Bienick | |
| 7,147,293 | B2 | 12/2006 | Bienick et al. | |
| 7,188,917 | B2 | 3/2007 | Bienick | |
| 7,237,855 | B2 | 7/2007 | Vardon | |
| 7,300,122 | B2 | 11/2007 | Vardon | |
| 7,306,304 | B2 * | 12/2007 | Jang | 312/408 |
| 2002/0047506 | A1 | 4/2002 | George | |
| 2002/0190620 | A1 | 12/2002 | Vardon | |
| 2005/0093409 | A1 | 5/2005 | Vardon | |
| 2005/0127806 | A1 | 6/2005 | Bienick | |
| 2005/0218767 | A1 | 10/2005 | Jeong et al. | |
| 2005/0280341 | A1 | 12/2005 | Vardon | |
| 2006/0145577 | A1 | 7/2006 | Daley et al. | |
| 2007/0046160 | A1 | 3/2007 | Egan | |
| 2007/0114897 | A1 | 5/2007 | Neumann | |
| 2008/0012459 | A1 | 1/2008 | Picken et al. | |
| 2008/0164797 | A1 | 7/2008 | Kim | |
| 2008/0203879 | A1 | 8/2008 | Lim et al. | |
| 2009/0195136 | A1 * | 8/2009 | Wing et al. | 312/408 |
| 2011/0089800 | A1 * | 4/2011 | Nash et al. | 312/404 |

* cited by examiner

REFRIGERATOR SHELF WITH GLASS RECEIVING SLOT

CROSS-REFERENCE TO RELATED APPLICATIONS

The present application claims the benefit of U.S. Provisional Patent Application No. 61/145,359 entitled "Refrigerator Shelf With Glass Receiving Slot" filed Jan. 16, 1009.

BACKGROUND OF THE INVENTION

1. Field of the Invention

The present invention pertains to the art of refrigerators and, more specifically, to a shelving assembly, including a peripheral frame provided with a slot which slidably receives a glass panel, for a refrigerator.

2. Description of the Related Art

It is common to provide vertically adjustable shelves in refrigerator cabinets in order to increase the versatility of storing a wide range of food items. To this end, mainly fresh food compartments of refrigerators have elongated, vertically extending and laterally spaced rails mounted on rear walls thereof, with the rails enabling shelves to be supported in selected vertically adjustable positions in a cantilevered manner. In other arrangements, pegs or rails are attached to or integrally formed with compartment side walls of a refrigerator in order to support shelves thereon. Providing various sets of the pegs or rails at vertically spaced locations along the side walls permits a consumer to vertically reposition a given shelf as desired.

Many refrigerator shelves are mounted in fixed positions in a refrigerator compartment. It has also been proposed in the art to enable shelves to be selectively slid partially out of a refrigerator compartment in order to enhance access to food items stored on rear portions of the shelves. Typically, with the case of cantilevered shelves, an overall shelf support frame must be provided to support a shelf both at the rear of the refrigerator compartment and for sliding movement relative to the support frame. In the case of shelves supported on liner side wall rails of a refrigerator compartment, the shelves can made to slide directly upon the side rails, while including structure preventing tipping of the slidable shelves. Shelves which are directly supported at the compartment side walls typically exhibit an advantage in that the shelves can extend substantially the full width of the refrigerator compartment.

In making a refrigerator shelf, it has become quite common to employ a glass panel as the shelf platform and to encapsulate the glass with a peripheral rim. Glass panels are seen to be aesthetically pleasing, easy to clean and structurally advantageous. In some known arrangements, the peripheral rim is actually molded directly about the glass panel. Other manufacturers will assemble a glass panel to a plastic frame when the frame is still at a high temperature from a molding process. Each of these arrangements generally provides for an inherent seal between the glass panel and the rim to prevent any spilled liquids or the like from running off the shelf. Unfortunately, these types of shelves require somewhat complicated and expensive molding techniques, while the established degree of sealing is not really required. Also known is ultrasonically weld frame parts around a glass panel, which creates an aesthetic shelf but requires more precision manufacturing and assembly. In still other known arrangements, the peripheral rim or frame will be separately made, with the glass panel being attached to the frame. Many of these types of known shelves have generally required either rather elaborate brackets and fasteners, or were simply cumbersome and difficult to assemble.

Even though various arrangements have been proposed to interconnect a glass panel to a separately formed peripheral rim or frame in forming a refrigerator shelf, there is still seen to exist a need in the art for an improved arrangement wherein a glass panel can be easily positioned in a separately formed peripheral frame to create a refrigerator shelf which is economical to manufacture, sturdy in construction and aesthetically appealing, while also being easily made as either a fixed or sliding shelving assembly.

SUMMARY OF THE INVENTION

The present invention is directed to an encapsulated refrigerator shelf formed by interconnecting a glass panel with a peripheral frame. More specifically, in accordance with preferred embodiments of the invention, a peripheral shelf frame is formed with a split side portion defining upper and lower frame portions which are spaced by a slot. The encapsulated glass refrigerator shelf is made by slidably inserting a glass panel onto peripheral frame support structure through the slot formed between the upper and lower frame portions. The frame is also formed with retaining structure to maintain the glass shelf in place once the glass shelf is inserted a requisite amount.

In certain preferred forms of the invention, support channels are formed on two or more of the sides of the frame. The slot is aligned with the channels such that the glass panel can smoothly transition into the channels from the slot. In addition, one or more of the split, upper and lower frame portions is formed with at least one retaining member, such as a tapered or hooked projection, which is designed to engage the glass panel after a predetermined degree of insertion, in order to secure the glass panel in the frame. Although the encapsulated glass shelf of the invention could be mounted in a refrigerator compartment in various ways, it is preferred to provide side walls of the refrigerator compartment with a series of fore-to-aft extending and vertically spaced shelf supporting rails, thereby enabling the shelf to be supported at a select vertical height within the refrigerator compartment. The frame is also formed with anti-tipping and/or slide limiting structure which co-acts with the supporting rails.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
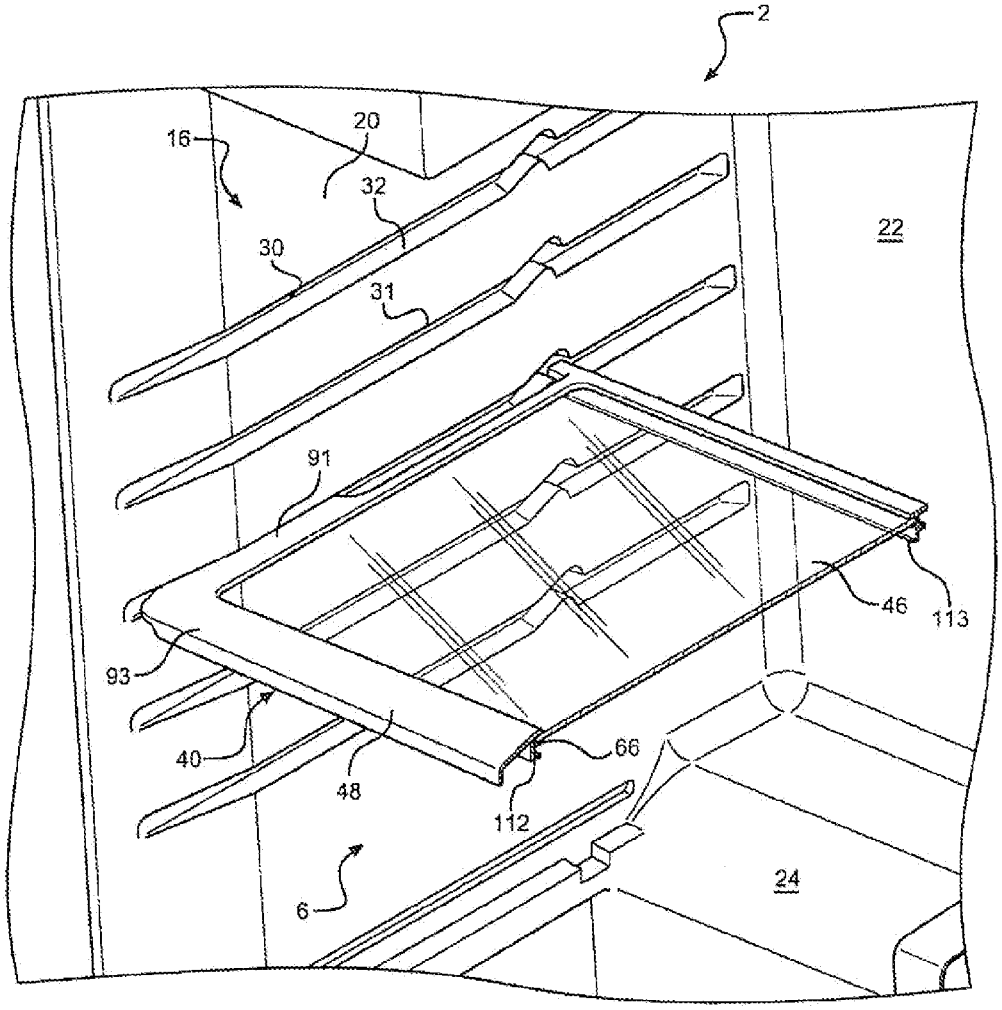
FIG. 1 is a partial perspective view of a refrigerator having a compartment within which is mounted a refrigerator shelf constructed in accordance with the invention.

FIG. 1 illustrates a portion of an interior of a refrigerator 2, actually depicted as a top mount style refrigerator but which could equally be a bottom mount, side-by-side, French door or other style refrigerator for purposes of the present invention. Actually, a portion of a fresh food compartment 6 of refrigerator 2 is shown to be made from a liner 16 including side walls, one of which is indicated at 20, a rear wall 22, a bottom wall 24 and a top wall (not shown). In a manner known in the art, liner 16 is preferably thermoformed. More specifically, in the most preferred arrangement, each of the side walls 20 is preferably formed with various vertically spaced sets of opposing rails 30 arranged directly opposite one another. At this point, it should be noted that the exact configuration of rails 30 does not form part of the invention. Therefore, although rails 30 are preferably integrally formed with liner 16, it should be noted that the invention is applicable for use in connection with supplemental rails which are separately fastened to side walls 30, such as through the use of mechanical fasteners or the like. In fact, the invention can actually be employed with any known refrigerator shelf support system. In any case, for the sake of completeness, it is noted that each depicted rail 30 defines a fore-to-aft extending groove and includes a top rail surface 31 and a bottom rail surface 32. In addition, it should be realized that each rail 30 can be formed with various gaps, raised portions, lowered portions, recessed portions or the like without departing from the invention.

In any event, each set of rails 30 is adapted to support a shelf which is generally indicated at 40. As shown in FIG. 1, shelf 40 includes a platform, preferably in the form of a glass panel 46, and a peripheral frame 48. In preferred forms of the invention, peripheral frame 48 is molded of plastic. More specifically, in accordance with the invention, frame 48 is formed separate from glass panel 46 such that glass panel 46 needs to be assembled to frame 48, whereby frame 48 surrounds glass panel 46 and generally defines a raised peripheral rim which aids in retaining food items (not shown) on glass panel 46. In some cases, a sealant can be applied between frame 48 and glass panel 46 to protect against any matter spilled upon glass panel or platform 46 from flowing off of shelf 40 and into other portions of the fresh food compartment. In general, encapsulated shelving is known in the art. Therefore, the present invention is particularly directed to the construction and assembly of shelf 40 as discussed in detail below.

Figure 2:
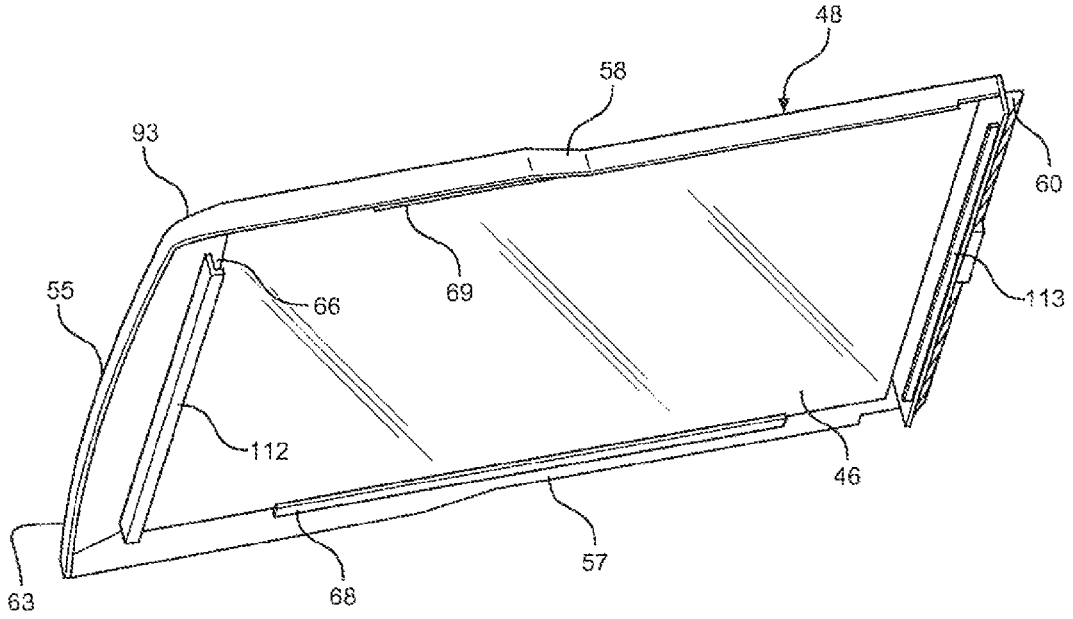
FIG. 2 is a lower perspective view of the refrigerator shelf of FIG. 1.
Figure 3:
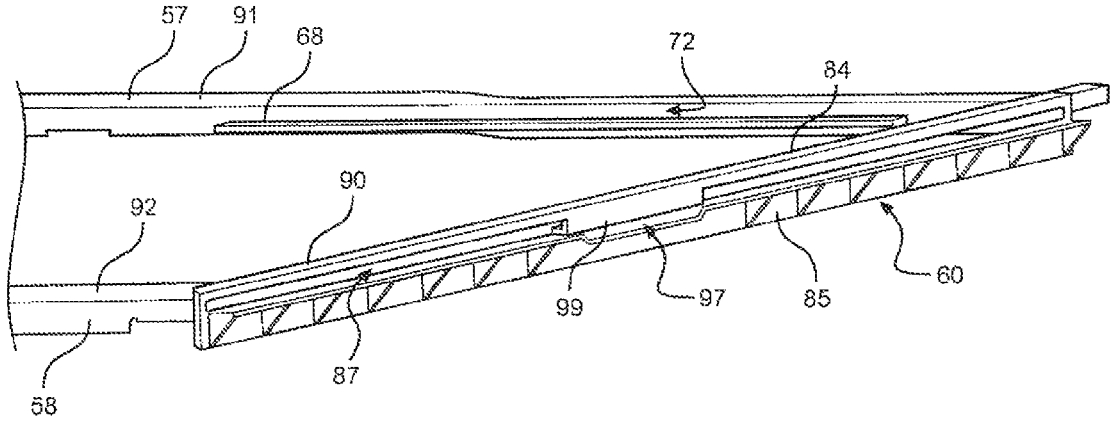
FIG. 3 is a partial perspective view particularly illustrating a slot defining split rear frame portion of the refrigerator shelf of FIG. 2.
Figure 4:
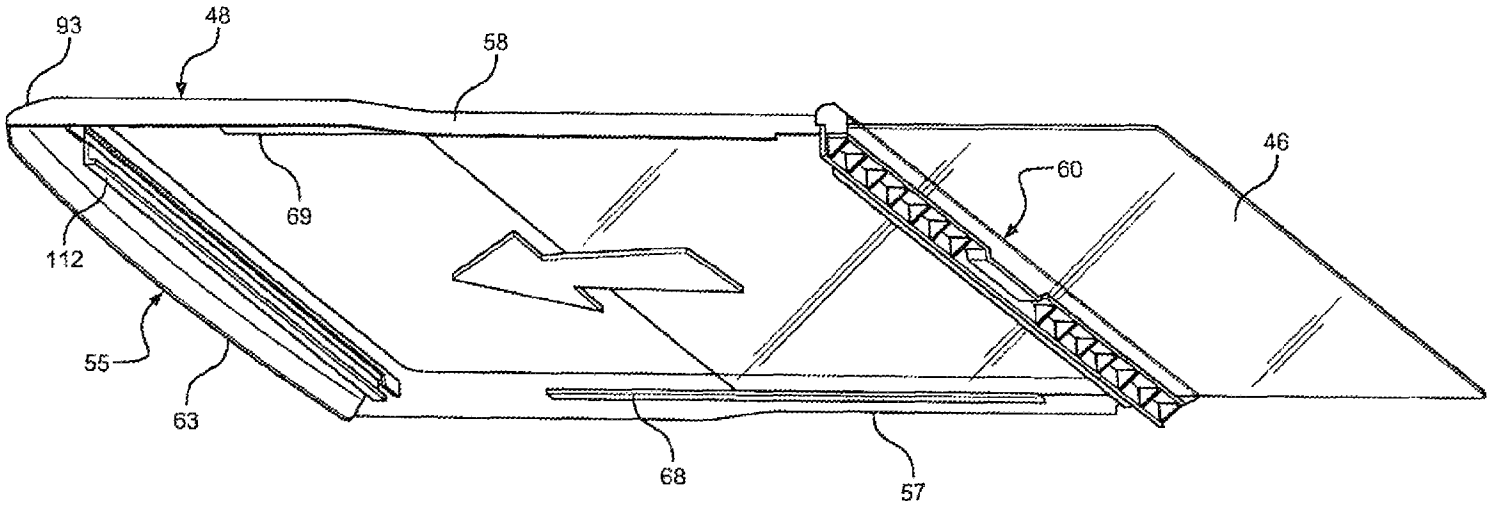
FIG. 4 shows the frame of FIGS. 1-3 partially receiving a glass panel of the refrigerator shelf.
Figure 5:
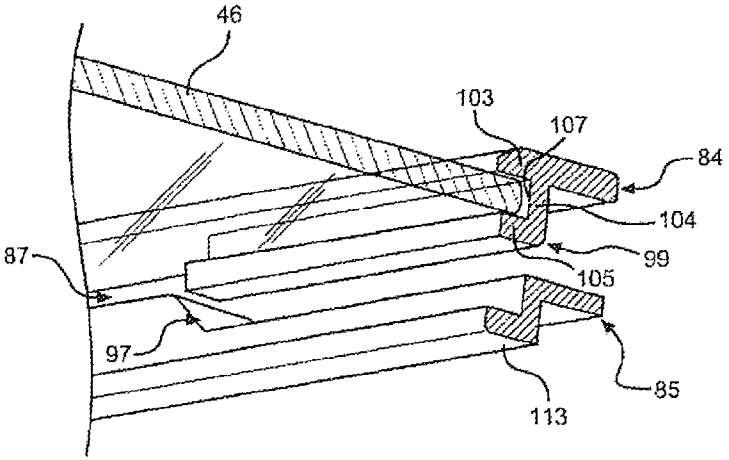
FIG. 5 is an enlarged, partial cross-sectional view of a section of the split rear frame portion of FIG. 3 highlighting retaining structure for the glass panel.
Figure 6:
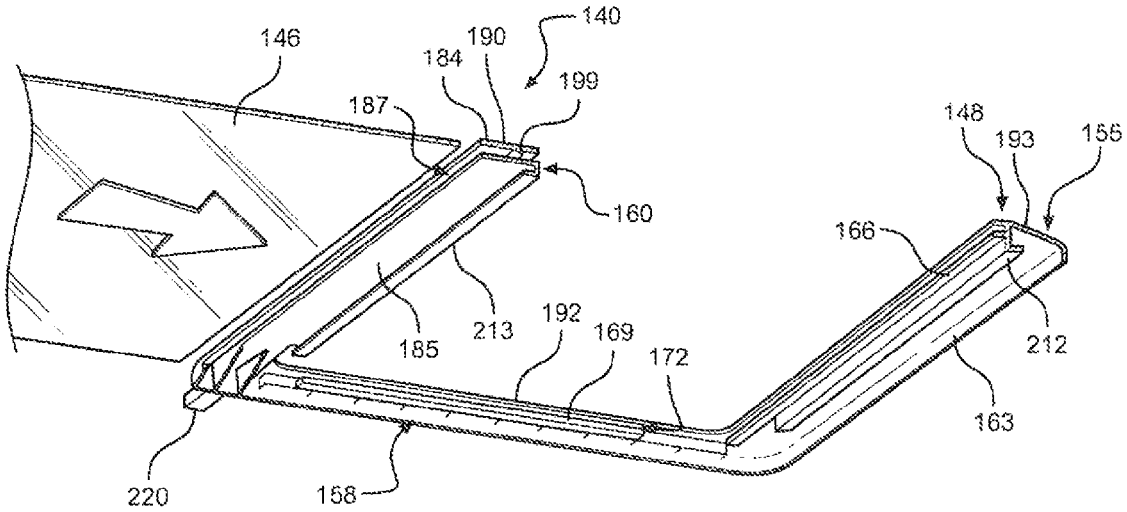
FIG. 6 is an exploded, cross-sectional view particularly illustrating a slot defining split rear frame portion adapted to receive a glass panel in accordance with a second refrigerator shelf embodiment of the invention.

FIGS. 1-5 will now be referenced to outline further details of shelf 40 as constructed in accordance with one embodiment with the present invention. As illustrated, peripheral frame 48 includes a front frame portion 55, side frame portions 57 and 58 and a rear frame portion 60. As best illustrated in FIGS. 1, 2 and 4, front frame portion 55 includes a downturned front wall 63 which is adapted to be arranged forwardmost within fresh food compartment 6 and blocks a consumer's view of the under structure of shelf 40, while also establishing a handle or gripping portion for a user in connection with potentially sliding of shelf 40 into and out of fresh food compartment 6. Projecting rearward from front frame portion 55 is a laterally extending front ledge 66. In a similar manner, fore-to-aft extending side ledges 68 and 69 extend from side frame portions 57 and 58 respectively. As will be discussed more fully below, each of ledges 66, 68 and 69 aids in defining a respective channel, one of which is indicated at 72 in FIG. 3 at side frame portion 57, into which glass panel 46 is to be positioned upon assembling of shelf 40.

As perhaps best shown in FIG. 3, rear frame portion 60 in accordance with the present invention is split so as to define an upper frame portion 84 and a lower frame portion 85 with an elongated gap or slot 87 there between. Upper frame portion 84 defines a top surface 90 of rear frame portion 60. Top surface 90 is shown arranged in a generally common plane with a top surface 91 of side frame portion 57, a top surface 92 of side frame portion 58 and a top surface 93 of front frame portion 55. The structure defining top surfaces 91-93 cooperate with respective ledges 66, 68 and 69 to define the various glass receiving channels, such as channel 72. In this embodiment, lower frame portion 85 of rear frame portion 60 is shown to include a central recessed zone 97. Extending from upper frame portion 84 above recessed zone 97 is a retainer member 99. As perhaps best shown in FIG. 5, retainer member 99 includes an upper section 103 in part defining top surface 90, an upright wall section 104 depending from upper section 103, and a lower, forwardly projecting section 105. Between upper section 103 and lower section 105 is defined a receiving channel 107.

In accordance with the invention, as mentioned above, peripheral frame 48 is formed separate from glass panel 46. More specifically, peripheral frame 48 is preferably molded of plastic and is adapted to receive glass panel 46 during the assembly of shelf 40. For receiving glass panel 46, rear frame portion 60 is split as described above into upper frame portion 84 and lower frame portion 85. As best illustrated in FIG. 4, upper and lower frame portions 84 and 85 are separated to receive glass panel 46 beneath retainer member 99. After extending through the elongated gap or slot 87, glass panel 46 is received upon side ledges 68 and 69 in the respective channels 72. Further sliding of glass panel 46 causes a front edge (not labeled) of glass panel 46 to reach and be supported upon front ledge 66. At this time, glass panel 46 is fully inserted. Thereafter, upper frame portion 84 is flexed, such as with a slight counter-clockwise rotation of lower section 105 as viewed in FIG. 5, which enables glass panel 46 to clear retainer member 99 whereupon upper frame portion 84 is allowed to assume its normal position in which a rear edge (not labeled) of glass panel 46 is positioned within receiving channel 107 as clearly shown in FIG. 5. Given the alignment of channel 72 and elongated slot 87, retainer member 99 actually will become nested in recessed zone 97 and upper frame portion 84 will be supported by lower frame portion 85, particularly upon loading of food items upon platform 46.

With the above construction, it should be readily apparent that elongated slot 87 aids in guiding glass panel 46 into receiving channel 72 for easy assembly of shelf 40. The inclusion of retainer member 99 prevents glass panel 46 from sliding out of peripheral frame 48 upon full assembly of shelf 40. Once fully assembled, shelf 40 can be positioned on a desired set of rails 30 as shown in FIG. 1. Although not a main aspect of the present invention, shelf 40 can be structured to support a lower frame which can receive a slide-out bin or the like. To this end, FIGS. 2 and 4 clearly illustrate a cantilevered pan support member 112 depending from front frame portion 55, while lower frame portion 85 includes a corresponding cantilevered pan support member 113. Again, since the supporting of a pan below shelf 40 is not the subject of the present invention, it will not be described further herein.

Reference will now be made to FIGS. 6-9 in describing a second preferred embodiment of the invention. This embodiment illustrates a shelf 140 including a platform in the form of a glass panel 146 and a peripheral frame 148. In a manner directly analogous to peripheral frame 48, peripheral frame 148 is preferably injection molded of plastic to include a front frame portion 155, side frame portions (one of which is shown at 158), and a rear frame portion 160. Again, front frame portion 155 includes a down-turned front wall 163 and is also provided with a front ledge 166. Front ledge 166 cooperates with side ledges, one being shown at 169, to define respective channels, one of which is indicated at 172 for receiving glass panel 146 as described more fully below. Again, in a manner similar to that described above with respect to the first embodiment, shelf 140 includes a split rear frame portion 160 such that rear frame portion 160 includes an upper frame portion 184 and a lower frame portion 185 which is separated by an elongated gap or slot 187. Upper frame portion 184 includes a top surface 190 which, along with the top surfaces of the side frame portions (one of which is shown at 192 for side frame portion 158) and top surface 193 of front frame portion 155 defines a peripheral rim extending about glass panel 146 upon the full assembly of shelf 140.

Figure 7:
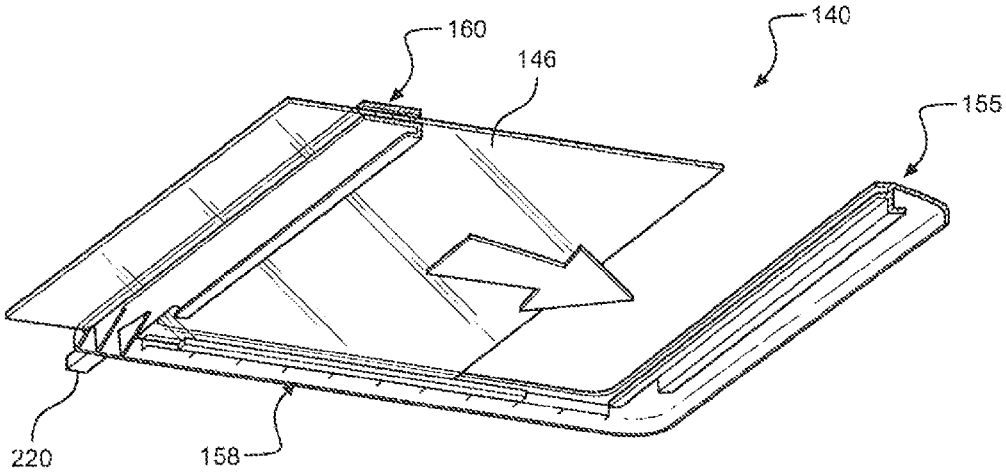
FIG. 7 shows the glass panel of FIG. 6 partially inserted into the frame in accordance with the second embodiment.
Figure 8:
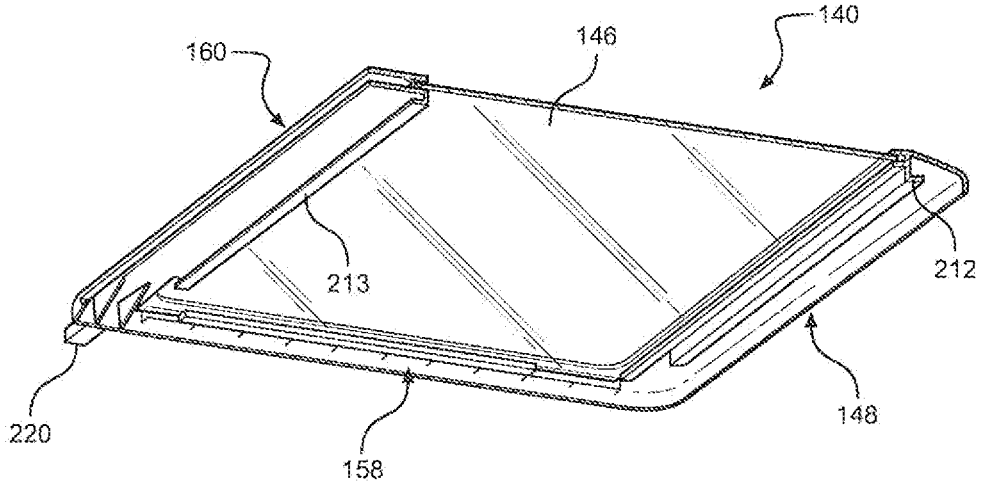
FIG. 8 is a cross-sectional side view of the refrigerator shelf of the second embodiment in a fully assembled state.
Figure 9:
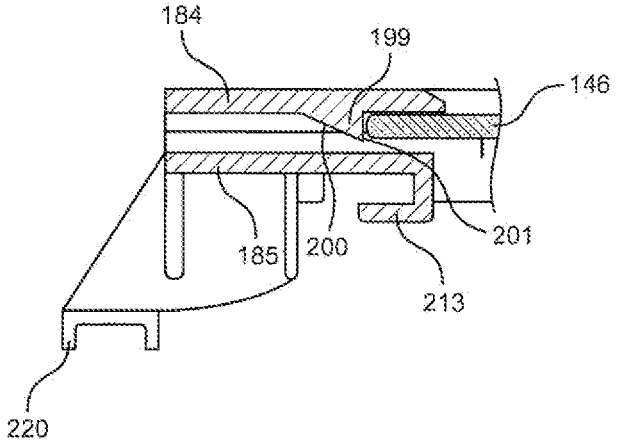
FIG. 9 is an enlarged detail view of retaining structure employed in connection with the second embodiment shown.

For assembly purposes, glass panel 146 is inserted into elongated slot 187 so as to be received within, for instance, the channel 172 defined by top surface 192 in combination with side ledge 169 as best shown in FIG. 7. Extending downwardly from upper frame portion 184 is at least one retainer member 199. As best illustrated in FIG. 9, retainer member 199 includes a slope or tapered entry surface 200 and an opposing, upright or stop wall surface 201. In the position shown in FIG. 9, glass panel 146 has been fully inserted within peripheral frame 148 and a rear edge (not labeled) of glass panel 146 abuts upright wall surface 201 of retainer member 199. In this fashion, glass panel 146 is prevented from sliding back out of peripheral frame 148 through elongated slot 187. During the insertion of glass panel 146, upper frame portion 184 can be raised relative to lower frame portion 185. To this end, tapered surface 200 of retainer member 199 enhances the passage of glass panel 146 through elongated slot 187 and into channels 172, until the point where glass panel 146 rests upon front ledge 166 and extends forward beyond tapered surface 200 and upright wall portion 201, as again clearly indicated in FIG. 9.

In a manner also corresponding to that described above with respect to shelf 40, shelf 140 is shown to include cantilevered pan support members 212 and 213. In addition, each side frame portion 158 is preferably formed with a down-turned and outwardly projecting flange member 220 which is adapted to extend beneath a bottom rail surface of a respective rail (not shown) upon mounting shelf 140 within fresh food compartment 6. More specifically, this shelf embodiment is actually configured to rest upon opposing rails (not shown) which project into fresh food compartment 6 from the side walls 20, with flange member 220 extending beneath a respective rail in order to prevent undesired tipping of shelf 140. This arrangement is considered particularly advantageous in connection with slide-out versions of shelf 140, with flanges 220 also cooperating with the structure of the rails to act as a stop in limiting any available degree of sliding. However, as discussed above with respect to the first embodiment of the invention, the shelves of the invention can be mounted within a refrigerator compartment in various ways known in the art and the particular mounting is not a material part of the invention.

Based on the above, it should be readily apparent that both of the shelf embodiments described above provides a peripheral shelf frame that is formed with a split side portion defined by upper and lower frame portions that are spaced by a slot adapted to receive a glass panel. The glass panel is retained within support channels and the frame is provided with retaining structure to maintain the glass shelf in place once the glass shelf is inserted a requisite amount. The slot is aligned with channels such that the glass panel can smoothly transition into the channels from the slot. In this fashion, a refrigerator shelf constructed in accordance with the invention is economical to manufacture, sturdy in construction and aesthetically appealing. The peripheral frame of the shelf can be readily constructed to provide for a fixed or sliding shelving arrangement which cooperates with side rails or other shelf supporting structure within a refrigerator compartment. Although described with reference to preferred embodiments of the invention, it should be readily understood that various changes and/or modifications can be made to the invention without departing from the spirit thereof. In general, the invention is only intended to be limited by the scope of the following claims.

What is claimed is:

1. A refrigerator comprising:

a liner defining a food compartment; and a shelving assembly mounted within the food compartment defined by the liner for supporting food stored within the refrigerator, said shelving assembly including:

front, rear and opposing side frame members interconnected to establish a peripheral frame, one of the front, rear and opposing side frame members constituting a split frame member defined by upper and lower frame portions which are spaced by an elongated slot;

a platform slidably received within the elongated slot in order to be supported by a plurality of the front, rear and opposing side frame members within the peripheral frame; and a retainer member provided on one of the upper and lower frame members within the slot for retaining the platform within the peripheral frame upon extending through the elongated slot.

2. A refrigerator shelving assembly comprising:

front, rear and opposing side frame members interconnected to establish a peripheral frame, one of the front, rear and opposing side frame members constituting a split frame member defined by upper and lower frame portions which are spaced by an elongated slot;

a platform slidably received within the elongated slot in order to be supported by a plurality of the front, rear and opposing side frame members within the peripheral frame; and a retainer member provided on one of the upper and lower frame members within the slot for retaining the platform within the peripheral frame upon extending through the elongated slot.

3. The refrigerator shelving assembly according to claim 2, further comprising: a plurality of ledges formed on at least two of the front, rear and opposing side frame members, said platform being supported upon the plurality of ledges within the peripheral frame.

4. The refrigerator shelving assembly according to claim 3, wherein the plurality of ledges are formed on the opposing side frame members and define channels within which the platform is slidably received through the elongated slot which is formed in the rear side frame member.

5. The refrigerator shelving assembly according to claim 4, further comprising: an additional ledge formed on the front frame member, with the additional ledge further supporting the platform within the peripheral frame.

6. The refrigerator shelving assembly according to claim 2, wherein the front, opposing side and rear frame members establish an upper peripheral rim which is raised above and extends about the platform.

7. The refrigerator shelving assembly according to claim 6, wherein the platform is defined by a glass panel.

8. The refrigerator shelving assembly according to claim 2, wherein the retainer member directly engages the platform within the elongated slot.

9. The refrigerator shelving assembly according to claim 2, wherein the retainer member includes an upright wall portion and a projecting section establishing a receiving channel within which the platform is receive to prevent the platform from sliding out of the peripheral frame.

10. The refrigerator shelving assembly according to claim 9, further comprising: a central recessed zone formed in the lower frame member, wherein the retainer member extends from the upper frame member and is aligned to extend into the central recessed zone.

11. The refrigerator shelving assembly according to claim 2, wherein the retainer member includes a tapered wall surface against which the platform slides in order to pass through the elongated slot.

12. The refrigerator shelving assembly according to claim 11, wherein the retainer member further includes an upright wall surface, opposite the tapered wall surface, with the upright wall surface defining a stop preventing the platform from sliding out of the peripheral frame.

13. The refrigerator shelving assembly according to claim 2, further comprising: front and rear pan supports projecting from the front and rear frame members for supporting a drawer frame from the peripheral frame.

14. A method of assembling a refrigerator shelf adapted to be mounted within a food compartment for supporting food stored within the refrigerator comprising:

sliding a platform through an elongated slot spacing upper and lower frame members of a peripheral shelving frame until the platform is supported upon ledges within the peripheral frame;

continuing to slide the platform through the elongated slot until the platform passes a retainer member provided within the slot; and preventing the platform from sliding out of the peripheral frame following insertion through the elongated slot by engaging the platform with the retainer member within the slot.

15. The method of claim 14, wherein the peripheral frame is defined by front, rear and opposing side frame members, with the rear side frame member being split to define the upper and lower frame members and the ledges being provided along the opposing side frame members such that the platform is inserted into the peripheral frame through the elongated slot of the rear side frame member and supported upon the ledges provided along the opposing side frame members.

16. The method of claim 14, wherein the retainer member includes an upright wall portion and a projecting section establishing a receiving channel, with the upper frame member being flexed to receive the platform in the receiving channel in order to prevent the platform from sliding out of the peripheral frame.

17. The method of claim 16, wherein the lower frame includes a central recessed zone, with the retainer member extending into the central recessed zone upon loading of the platform.

18. The method of claim 14, wherein the retainer member includes a tapered wall surface, with the platform sliding against the tapered wall surface in order to pass through the elongated slot.

19. The method of claim 18, wherein the retainer member further includes an upright wall surface opposite the tapered wall surface, with the platform abutting the upright wall surface upon sliding the platform through the elongated slot in order to stop the platform from sliding out of the peripheral frame.

20. The method of claim 14, wherein the peripheral shelving frame must flex in order for the platform to slide past the retainer member within the slot.

* * * * *